US006971788B1

(12) United States Patent
Gringer et al.

(10) Patent No.: US 6,971,788 B1
(45) Date of Patent: Dec. 6, 2005

(54) FLUID MIXING DEVICE

(75) Inventors: Donald Gringer, New York, NY (US); Yuan Fang Cheng, Forest Hills, NY (US); Howard Soled, Paramus, NJ (US)

(73) Assignee: Site-b Company, Bellingham, WA (US)

( * ) Notice: Subject to any disclaimer, the term of this patent is extended or adjusted under 35 U.S.C. 154(b) by 0 days.

(21) Appl. No.: 10/789,726

(22) Filed: Feb. 27, 2004

Related U.S. Application Data

(63) Continuation of application No. 09/928,542, filed on Aug. 13, 2001, now abandoned.

(60) Provisional application No. 60/224,702, filed on Aug. 11, 2000.

(51) Int. Cl.[7] ..... B01F 5/12; B01F 7/32
(52) U.S. Cl. ..... 366/265; 366/325.94
(58) Field of Search ..... 366/255, 263, 366/325.432, 325.1, 325.94

(56) References Cited

U.S. PATENT DOCUMENTS

| | | | | | |
|---|---|---|---|---|---|
| 59,493 | A | | 11/1866 | Willcox | |
| 444,345 | A | | 1/1891 | Gabbett | |
| 612,317 | A | | 10/1898 | Dundon | |
| 662,525 | A | * | 11/1900 | Davidson | 416/187 |
| 1,031,180 | A | * | 7/1912 | Hancock | 415/97 |
| 1,067,007 | A | | 7/1913 | Douglas | |
| 1,084,210 | A | * | 1/1914 | Howard | 366/302 |
| 1,165,931 | A | * | 12/1915 | Akimoff | 416/186 R |
| 1,765,386 | A | * | 6/1930 | Wait | 366/265 |
| 1,908,002 | A | * | 5/1933 | Valentine | 366/265 |
| 1,919,970 | A | | 7/1933 | Woods | |
| 2,033,453 | A | | 3/1936 | Strief | |
| 2,045,919 | A | | 6/1936 | Parraga | |
| 2,190,896 | A | | 2/1940 | Underwood | |
| 2,226,470 | A | | 12/1940 | McGuffee | |
| 2,230,146 | A | | 1/1941 | Myers | |
| 2,244,814 | A | | 6/1941 | Underwood | |
| 2,244,815 | A | | 6/1941 | Underwood | |
| 2,254,127 | A | | 8/1941 | Underwood | |
| 2,520,540 | A | | 8/1950 | Green | |
| 2,530,814 | A | * | 11/1950 | De Becze et al. | 366/263 |
| 2,619,330 | A | * | 11/1952 | Willems | 366/263 |
| 2,655,436 | A | | 10/1953 | Bishop et al. | |
| 2,724,547 | A | | 11/1955 | Abbott et al. | |
| 2,736,537 | A | | 2/1956 | Nelsson | |

(Continued)

FOREIGN PATENT DOCUMENTS

| | | |
|---|---|---|
| DE | 2225800 | 12/1972 |

(Continued)

*Primary Examiner*—Tony G. Soohoo
(74) *Attorney, Agent, or Firm*—Weide & Miller, Ltd.

(57) ABSTRACT

A mixing device includes vanes arranged so that the outer edges of the vanes define a frusto-conical surface in order to facilitate improved circulation of the liquid being mixed. Each vane is preferably curved, either lengthwise, widthwise, or both. In one embodiment, the outer edges of the vanes are tapered outward to form the frusto-conical surface. In an alternative embodiment, the inner and outer edges of the vanes are aligned with each other, and the vanes are tilted relative to a central axis to form the frusto-conical surface. The vanes may extend between upper and lower rims having the same or different diameters. Turbines extend between the vanes and shaft for rotating the mixing device. The turbines are arranged to avoid inhibiting entry of liquids through the top and bottom of the mixing device. Feet extend downward from the bottom edge of the mixing device to facilitate mixing of liquids on the bottom of the container. The inner edges of the vanes define a frusto-conical surface in order to prevent clogging of the mixing device.

19 Claims, 8 Drawing Sheets

U.S. PATENT DOCUMENTS

| | | | | | |
|---|---|---|---|---|---|
| 2,753,162 | A | * | 7/1956 | Conley | 416/175 |
| 2,803,398 | A | | 8/1957 | Sprouse | |
| 2,879,044 | A | | 3/1959 | Gunas | |
| 3,147,957 | A | * | 9/1964 | Martin | 366/265 |
| 3,166,303 | A | | 1/1965 | Chapman | |
| 3,319,940 | A | | 5/1967 | Mentnech | |
| 3,362,338 | A | | 1/1968 | Stethem | |
| 3,362,689 | A | | 1/1968 | Rothman et al. | |
| 3,387,832 | A | | 6/1968 | Nelson | |
| 3,423,075 | A | | 1/1969 | Knudsen et al. | |
| 3,464,622 | A | | 9/1969 | Dennis | |
| 3,521,973 | A | | 7/1970 | Schouw | |
| 3,690,621 | A | * | 9/1972 | Tanaka et al. | 366/265 |
| 3,733,645 | A | | 5/1973 | Seiler | |
| 3,846,043 | A | | 11/1974 | Wolbrink et al. | |
| 3,920,227 | A | * | 11/1975 | Davis, Jr. | 366/329.1 |
| 3,942,770 | A | | 3/1976 | Belouet et al. | |
| 3,972,512 | A | | 8/1976 | Grisé et al. | |
| 4,159,191 | A | * | 6/1979 | Graybill | 416/11 |
| 4,163,616 | A | | 8/1979 | Claunch | |
| 4,175,875 | A | | 11/1979 | Van Horbek | |
| 4,451,155 | A | * | 5/1984 | Weber et al. | 366/265 |
| 4,472,063 | A | | 9/1984 | Eickelmann | |
| 4,483,624 | A | | 11/1984 | Bacon, Jr. et al. | |
| 4,534,657 | A | | 8/1985 | Clement | |
| 4,538,922 | A | | 9/1985 | Johnson | |
| 4,738,593 | A | | 4/1988 | Reifschneider | |
| 4,893,941 | A | | 1/1990 | Wayte | |
| 4,900,159 | A | | 2/1990 | Jamison | |
| 4,948,262 | A | | 8/1990 | Tome, Jr. | |
| 5,073,033 | A | | 12/1991 | Klepeis | |
| 5,251,979 | A | | 10/1993 | Larsen | |
| 5,257,902 | A | | 11/1993 | Atarashi et al. | |
| 5,261,745 | A | * | 11/1993 | Watkins | 366/250 |
| 5,314,310 | A | * | 5/1994 | Bachellier | 416/201 A |
| 5,417,493 | A | | 5/1995 | Ericson | |
| 5,865,539 | A | * | 2/1999 | Rogers | 366/325.8 |
| 5,984,518 | A | * | 11/1999 | King et al. | 366/129 |
| 5,988,979 | A | | 11/1999 | Wang | |
| 6,068,395 | A | | 5/2000 | Ondracek | |
| 6,523,995 | B2 | | 2/2003 | Fasano et al. | |
| 2003/0107950 | A1 | | 6/2003 | Shepherd et al. | |

FOREIGN PATENT DOCUMENTS

| | | |
|---|---|---|
| DE | 3245641 | 6/1984 |
| DE | 3616203 | 11/1987 |
| DE | 10134316 | 1/2003 |
| FR | 1151512 | 1/1958 |
| FR | 2385439 | 3/1977 |
| FR | 2605532 | 4/1988 |
| GB | 1064111 | 4/1967 |
| GB | 1206074 | 9/1970 |
| JP | 58-224637 | 12/1983 |

* cited by examiner

FLUID MIXING DEVICE

CROSS-REFERENCE TO RELATED APPLICATION

This application is continuation of U.S. patent application Ser. No. 09/928,542, filed Aug. 13, 2001, now abandoned, which application claims the benefit of Provisional Application Ser. No. 60/224,702, entitled "Fluid Mixing Device", filed Aug. 11, 2000, the contents of which are incorporated by reference herein in their entirety.

BACKGROUND OF THE INVENTION

1. Field of the Invention

The present invention relates generally to a mixing device for paint and other liquids, and more particularly to mixing device having vanes that form interior and/or exterior frusto-conical surfaces, and feet on the bottom of the mixer, to improve mixing and to prevent clogging.

2. Description of the Related Art

Rotating paint mixers for use with power drills are well known in the art. These devices generally include a shaft that is adapted to be attached to the driving end of the electric drill. The opposite end of the shaft includes an apparatus designed to be inserted into a can of paint or other liquid to mix the contents of the can.

One example of such a mixing device is disclosed in King et al., U.S. Pat. No. 5,984,518 ("King"). King discloses a method of mixing viscous fluids using a rotating cage attached to a shaft. The cage includes a central disc located at the end of the shaft with a plurality of vanes extending above and below the outer edge of the disc. Other rotating fluid mixing devices are shown, for example, in U.S. Pat. Nos. 4,538,922; 4,893,941; and 5,251,979.

In general, existing mixing devices suffer from several drawbacks when used to mix paint, most notably inefficient mixing and possible clogging. For example, in the King device, as the device is rotated, suspended globules may jam in the vanes against the disc, thereby clogging the device. The bottom set of vanes may also seal against the bottom surface of the container, thereby preventing proper flow of liquid through the mixer.

Accordingly, it would be desirable to have an improved mixing device that more efficiently mixes paint and other liquids, and that has a reduced likelihood of becoming clogged.

SUMMARY OF THE INVENTION

The present invention is a device for mixing paint or other liquids. The mixing device includes a plurality of aligned vanes, each vane having an inner edge and an outer edge, and each vane preferably being curved, either lengthwise, widthwise, or both. The vanes are arranged so that the outer edges of the vanes defining a tapered or frusto-conical surface in order to facilitate circulation of the liquid within its receptacle.

In one embodiment, the frusto-conical surface has a central axis, the inner edges of the vanes are aligned generally parallel or angled relative to the central axis, and the outer edges of the vanes are tapered outward to form the frusto-conical surface. In an alternative embodiment, the inner and outer edges of the vanes are aligned with each other, and the vanes are tilted at an angle relative to the central axis to form the frusto-conical surface.

If desired, the mixing device may include an upper rim and a lower rim having a common central axis. The upper rim has a diameter different from the diameter of the lower rim, and the vanes extend lengthwise between the upper rim and the lower rim. In this embodiment, the inner and outer edges of the vanes may either be aligned with each other or angled slightly, in either case forming the frusto-conical shape.

A shaft having a proximate end and a distal end is aligned along the central axis of the mixing device. The proximate end of the shaft is connected to at least some of the vanes for transmitting a rotating force on shaft to the vanes, with the distal end of the shaft being adapted to be attached to a rotating drive means. A plurality of turbines extend between the vanes and the shaft. Each turbine includes a first end attached to the shaft in fixed relation thereto for transmitting a rotating force on the shaft to the turbine, and a second end attached to the vanes in fixed relation for transmitting a rotating force on the turbine to the vanes.

In one embodiment, the turbines extend lengthwise between the shaft and the vanes, and widthwise, the turbines are aligned parallel with the central axis extending radially outward therefrom, so that the turbines do not inhibit entry of liquids through the top and bottom openings.

In order to facilitate mixing of paint and liquids on the bottom of the storage receptacle, a plurality of feet extend downward from the lower rim. Alternatively, a first group of the vanes may have a first length, and a second group of the vanes may have a second length longer than the first length. A bottom edge of the second group of vanes extends below a bottom edge of the first group of vanes for defining feet extending downwardly from the bottom edge of the first group of vanes. The vanes are arranged in a regular pattern alternating between vanes from the first group and vanes from the second group. Each of the feet is preferably curved, having a convex side and a concave side. The feet are also preferably orientated generally parallel with each other, either in the same direction as the vanes or in the opposite direction as the vanes.

In an alternative embodiment of the invention, the mixing device includes the vanes arranged so that the inner edges of the vanes define a frusto-conical surface, in order to prevent clogging of paint within the mixing device. In one embodiment, the outer edges of the vanes are aligned generally parallel with or angled relative to a central axis of the mixing device, and the inner edges of the vanes are tapered to form the frusto-conical surface. In an alternative embodiment, the inner and outer edges of the vanes are aligned with each other, and the vanes are tilted at an angle relative to the central axis to form the interior frusto-conical surface. If desired, the vanes may extend lengthwise between the narrower upper rim and the wider lower rim, with the inner and outer edges of the vanes aligned with each other, thereby forming the interior frusto-conical shape.

An alternative mixing device of the present invention includes an upper rim and a lower rim having a common central axis. The upper rim has a diameter different from the diameter of the lower rim. A plurality of aligned vanes, each vane having an inner edge and an outer edge, extend lengthwise between the upper rim and the lower rim.

A further alternative mixing device of the present invention includes a plurality of aligned vanes, each vane having an inner edge and an outer edge. The vanes form a circular or frusto-conical shape having a central axis, a top opening and a bottom opening. A shaft having a proximate end and a distal end is aligned along the central axis, with the distal end of the shaft being adapted to be attached to a rotating drive means. A plurality of turbines is aligned lengthwise between the vanes and the proximate end of the shaft. Each turbine has a first end attached to the shaft in fixed relation thereto for transmitting a rotating force on the shaft to the turbine, and a second end attached to the vanes in fixed relation for transmitting a rotating force on the turbine to the vanes. The turbines are spaced widthwise to avoid inhibiting entry of liquids through the top and bottom openings. In one embodiment, the turbines are aligned widthwise generally parallel with the central axis. The turbines may be curved lengthwise or widthwise, as desired.

DETAILED DESCRIPTION OF THE INVENTION

Referring to FIGS. 1–6, a mixing device according to the present invention is shown generally at 10. Mixing device 10 preferably includes an upper rim 15 and a lower rim 25, each aligned along a common central axis C. A plurality of vanes 20 are positioned between upper rim 15 and lower rim 25 and are attached in fixed relation thereto. In a preferred embodiment, vanes 20, upper rim 15 and a lower rim 25 are integrally constructed of a thermoplastic material, although any appropriate material may be used. Vanes 20 are longitudinally aligned with each other to form a substantially circular shape at their ends corresponding to the circular shape of upper rim 15 and a lower rim 25.

Figure 3:
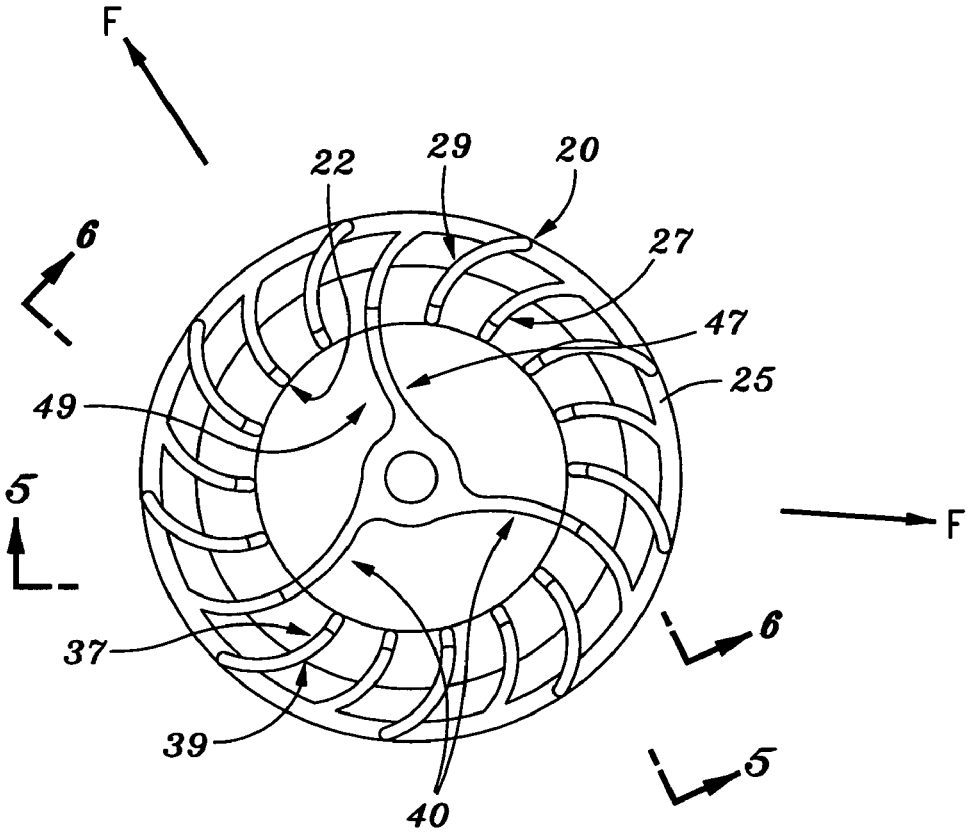
FIG. 3 is a bottom view of the mixing device of the present invention.
Figure 4:
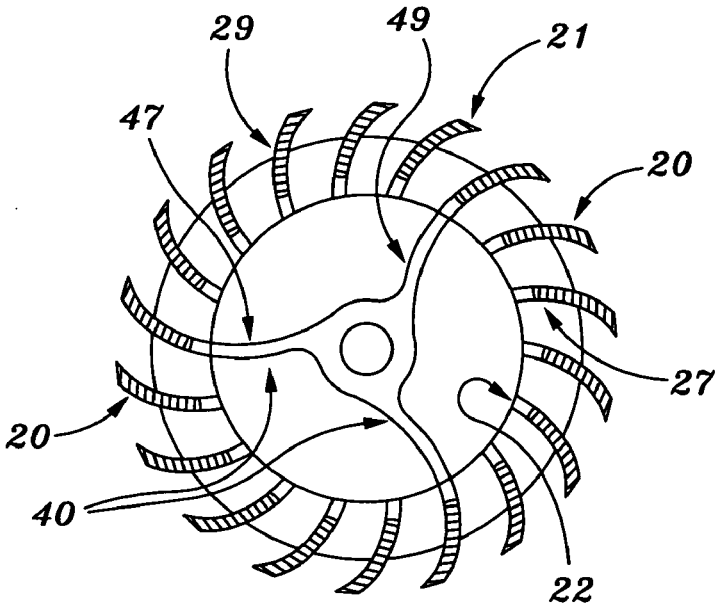
FIG. 4 is a section view of the mixing device of the present invention through Section 4—4 of FIG. 2.

As shown in FIGS. 3 and 4, each vane 20 is preferably curved, having a convex side 27 and a concave side 29, although such curvature is not necessary. Vanes 20 are preferably orientated in a direction that will allow outward movement of fluid within mixer 10 while in use, shown generally as direction F in FIG. 3.

The outer edges 21 of vanes 20 are preferably oriented to form a frusto-conical or truncated cone shaped surface, and inner edges 22 of vanes 20 also preferably oriented to form a frusto-conical or truncated cone shaped surface. In a preferred embodiment, vanes 20 preferably have a varying width, being narrower on the top than on the bottom, and upper rim 15 preferably has a smaller radius that lower rim 25. Thus, mixing device 10 has a trapezoidal interior cross-sectional shape where inner edges 22 of vanes 20 form an angle $\alpha$ of about 1–30 degrees, and preferably 3–5 degrees relative to central axis C. Similarly, mixing device 10 has a trapezoidal exterior cross-sectional shape where outer edges 21 of vanes 20 form an angle $\beta$ of about 1–30 degrees, and preferably 3–5 degrees relative to central axis C. As discussed in greater detail below, the taper of vanes 20 on the interior of mixing device 10 facilitates ejection of globules and other large particles from the mixer during use, and the taper of vanes 20 on the exterior of mixing device 10 facilitates improved mixing of the fluid being mixed by imparting a slight upward movement of the liquid as it is ejected from the mixing device. Since the diameters of the upper hoop and lower hoop are different, the end of each vane connected to the upper hoop is closer to the shaft than the end of each such vane connected to the lower hoop. Rather than being parallel to the shaft and forming a cylinder, the vanes are tilted relative to the central axis, preferably on their inside edges and their outside edges.

Figure 10:
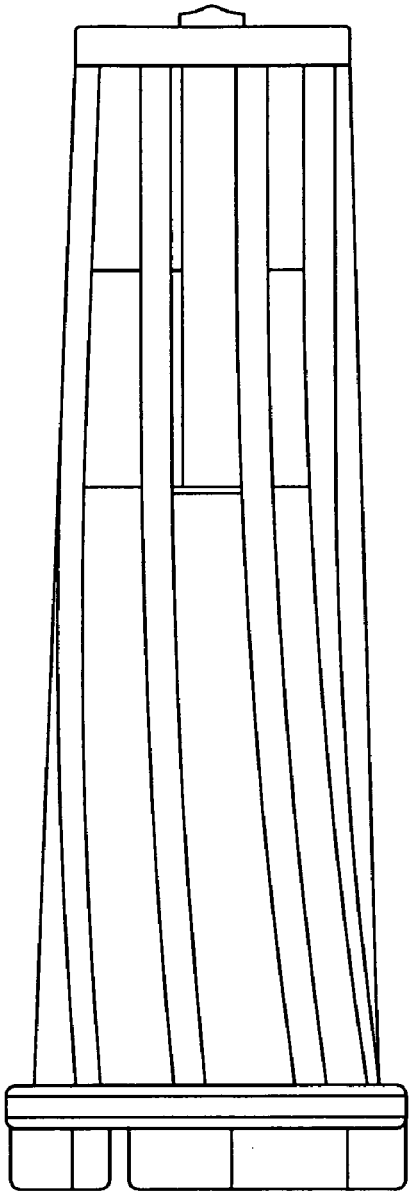
FIG. 10 is a side view of an alternative mixing device of the present invention.
Figure 11:
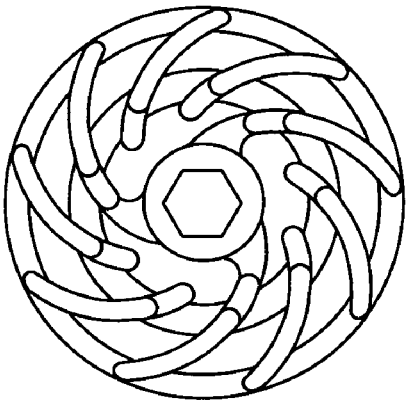
FIG. 11 is a bottom view of the mixing device shown in FIG. 10.

It is foreseen that various arrangements may be used to form the frusto-conical surfaces, including using tapered vanes and/or using non-tapered vanes that are tilted relative to axis C. Moreover, since the purpose of exterior frusto-conical surface is to facilitate improved mixing, it is foreseen that the frusto-conical surface may be angled either upward or downward, or that multiple frusto-conical surfaces may be used in a mixer, e.g., by having a downward facing frusto-conical surfaced mixer mounted on top of an upward facing frusto-conical surfaced mixer. More generally, the improved mixing benefit may be realized in a mixer in which the outer vanes are at any angle relative to axis C, including, for example, by being bulge-shaped. The shape of the mixer may also vary, depending on the application of the mixer. For example, the mixer shown in FIGS. 1–7 is generally sized for mixing in 1 gallon paint containers. Alternatively, the mixer shown in FIGS. 10 and 11 is generally sized for mixing in 5 gallon paint containers through a small opening in the top of the container. For other applications, e.g., for mixing fully open 5 gallon paint containers, and for mixing other smaller and larger receptacles, the device may be sized as appropriate.

A driving shaft 12 is aligned with common central axis C. Shaft 12 is preferably circular or hexagonal in cross-section and includes a proximate end 13 and a distal end 11. Distal end 11 of shaft 12 is sized to enable the shaft to be inserted into the driving end of a rotating drive means, which may be, for example, a drill or screwgun. In a preferred embodiment, shaft 12 is constructed of a metallic material capable of withstanding the torque to be applied to mixing device 10, although any material capable of withstanding such torque may be used. Proximate end 13 of shaft 12 is inserted into mounting aperture 30, and is secured thereto in fixed relation using conventional securing means. Shaft 12 may have any desired cross-section provided that it is capable of being secured to mounting aperture 30.

Figure 5:
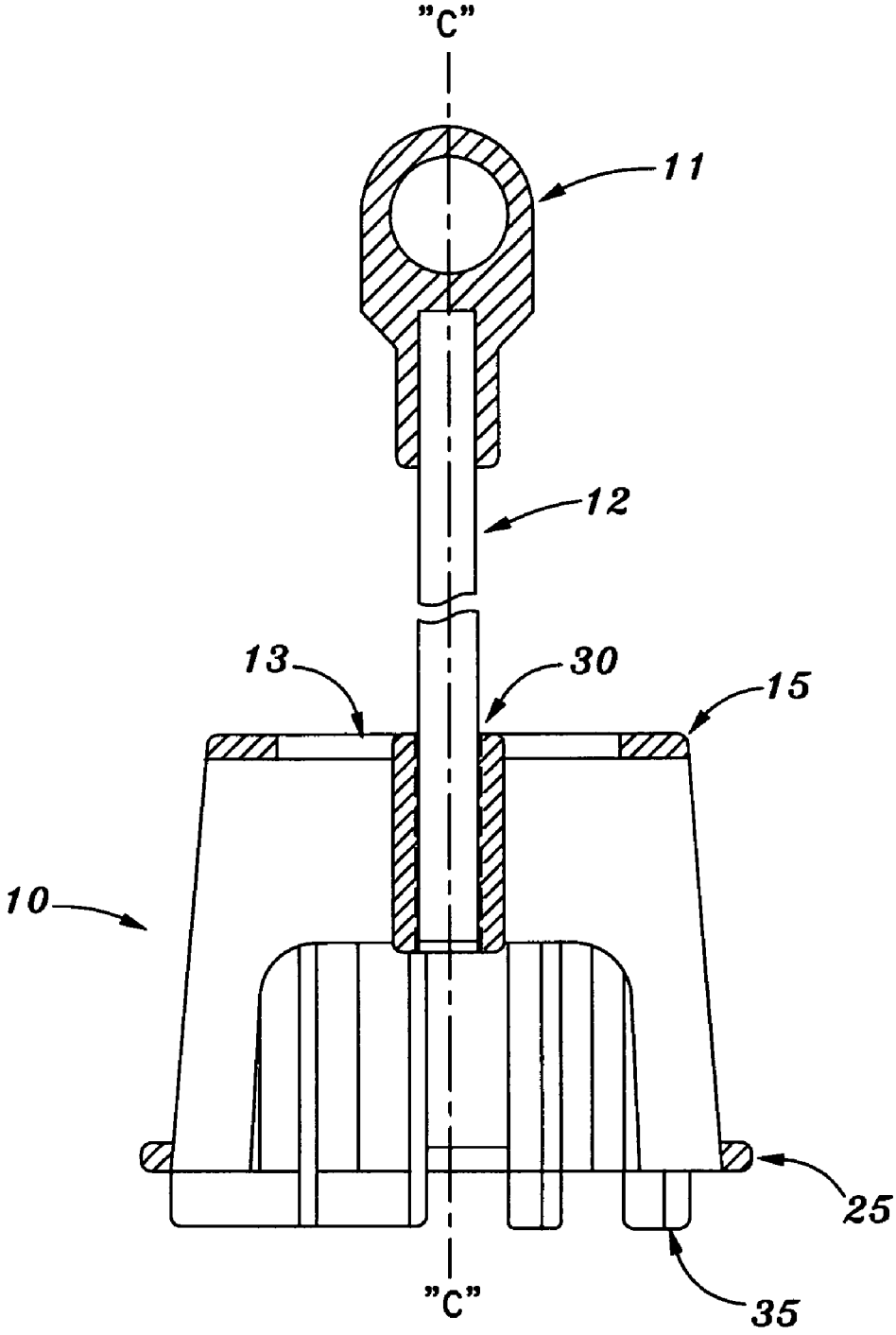
FIG. 5 is a section view of the mixing device of the present invention through Section 5—5 of FIG. 3.
Figure 6:
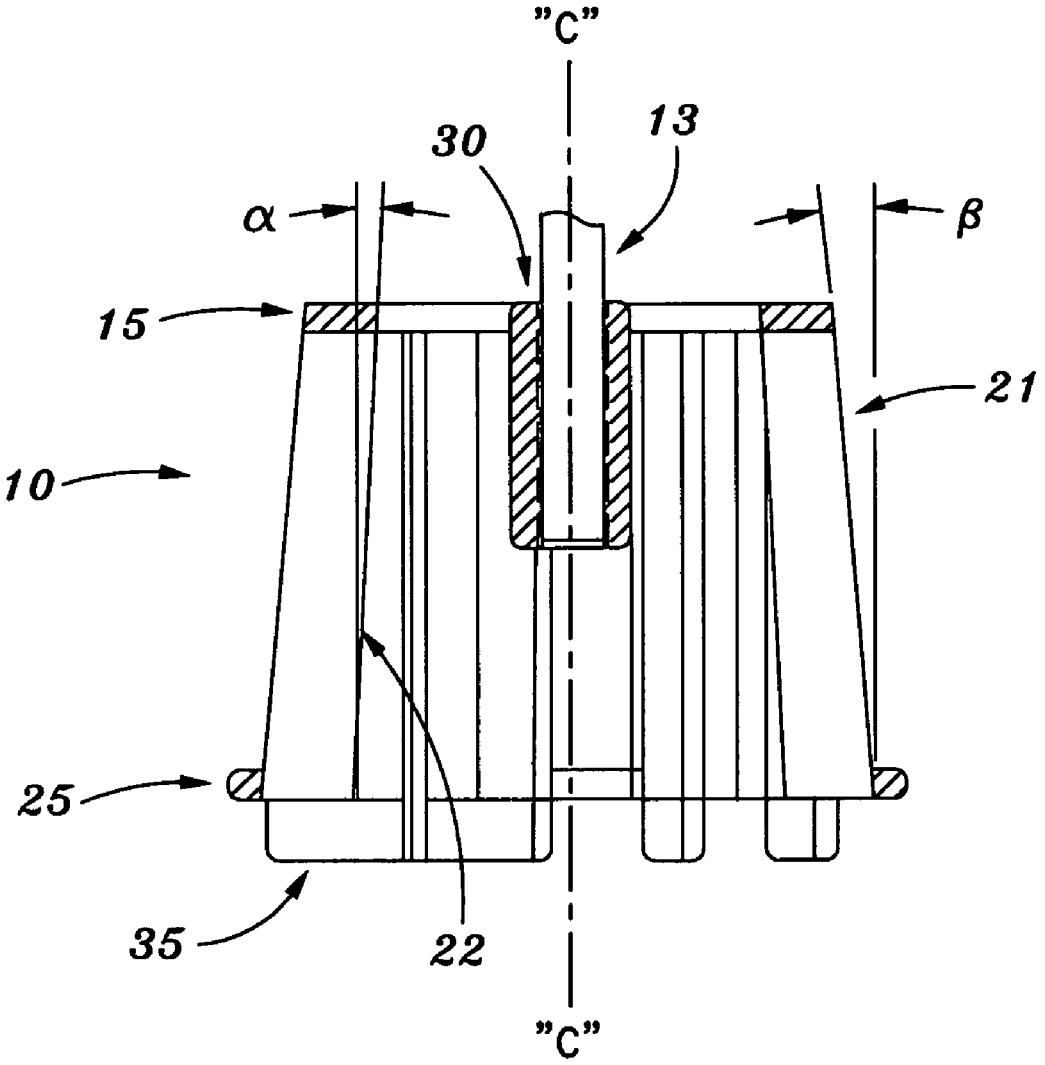
FIG. 6 is a section view of the mixing device of the present invention through Section 6—6 of FIG. 3.

Mixer 10 includes a plurality of spokes or turbines 40 extending between vanes 20 and a mounting aperture 30. Each spoke or turbine 40 is preferably shaped so that on the end attached to mounting aperture 30, it is narrowed, and at the end attached to vanes 20, it widens. If desired, as shown in FIG. 5, spoke or turbines 40 may, together with the vane to which each turbine is attached, be generally L-shaped. Turbines 40 may have any desired shape, e.g., triangular shaped, provided that the turbines have sufficient strength to enable the mixer to be rotated while mixing paint or other liquids. Turbines 40 create an opening in the top of the mixer that allows paint to flow in through the top of the mixer and out between the vanes or through the bottom of the mixer.

The shape of the turbines causes the turbines to laterally impact paint entering the top of the mixer, which disperses and mixes the paint, and which assists in adding additional outward force to eject the paint through the vanes.

If desired, shaft 12 may be integrally molded with turbines 40, and turbines 40 may be curved, with each having a convex side 47 and a concave side 49. Turbines 40 are preferably orientated with the curvature of the turbines being in the same direction as the vanes 20 to provide additional outward force on liquids in the interior of the mixer.

Mixing device 10 includes a plurality of feet 35 extending from the underside of lower rim 25, or otherwise positioned to extend along a bottom edge of the mixing device. Feet 35 are useful for scraping liquids from the bottom of the receptacle, where the liquid generally has the lowest viscosity and is more difficult to draw into the mixing device. Feet 35 loosen and collect liquid "sticking" to the bottom of the container, directing it to the interior of device 10 and eventually out through vanes 20. Feet 35 also prevent a sealing effect between the bottom of the container and the bottom of mixing device 10 by providing a gap through which liquid may flow. This gap ensures continuous fluid flow through lower rim 25 into the interior of the mixing device. Feet 35 are preferably curved in the same direction as vanes 20, with each having a convex side 37 and a concave side 39. If desired, feet 35 may be straight, although the feet should preferably by orientated in the same general direction.

Figure 8:
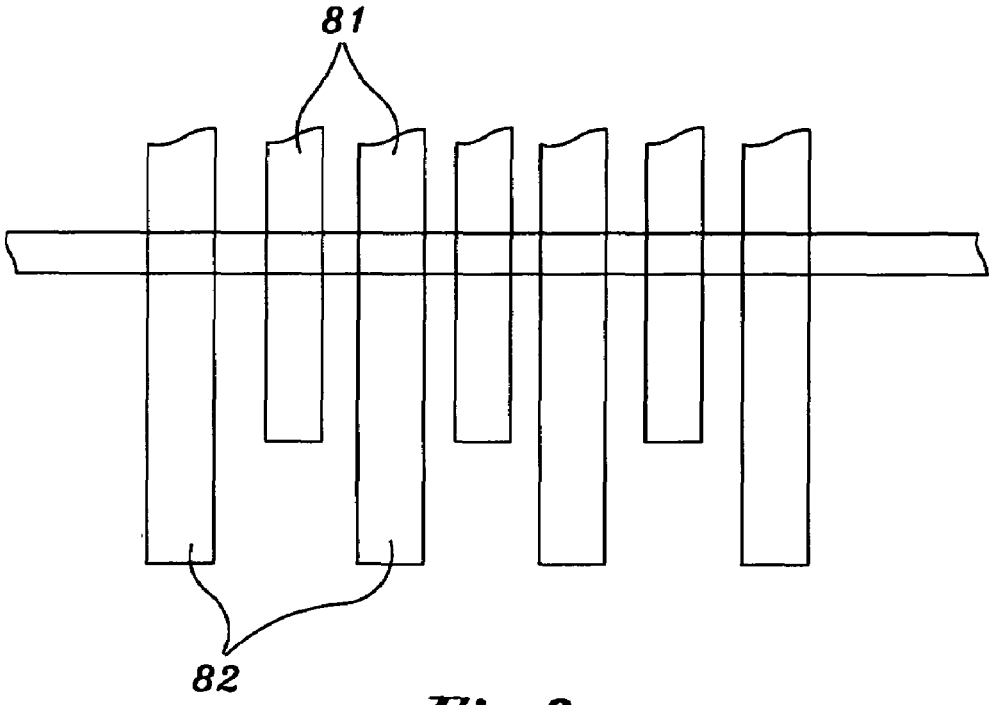
FIG. 8 is an exploded view of a series of vanes in an alternate embodiment of the present invention.
Figure 9:
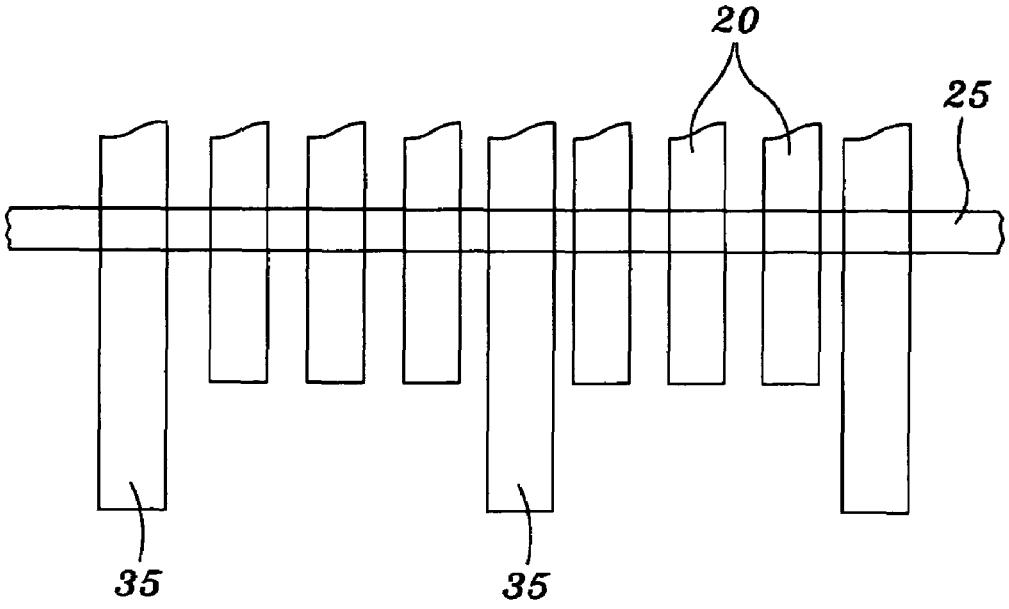
FIG. 9 is an exploded view of a series of vanes in a further alternate embodiment of the present invention

FIGS. 8 and 9 show alternative embodiments of the invention in which feet are included, but with lower rim 25 positioned above the bottom of the vanes. Referring to FIG. 8, mixer 10 may include a first plurality of vanes 81 that have a first length, and a second plurality of vanes 82 that have a second length longer than the first length. The bottom edge of the second group of vanes 82 extends below the bottom edge of the first group of vanes 81 for defining feet 35 extending downwardly from the bottom edge of the first group of vanes. The vanes are arranged in a regular pattern alternating between vanes from the first group and vanes from the second group. In FIG. 9, feet 35 are formed in a manner similar to that shown in FIG. 8, but with a different, but periodic, spacing.

Figure 1:
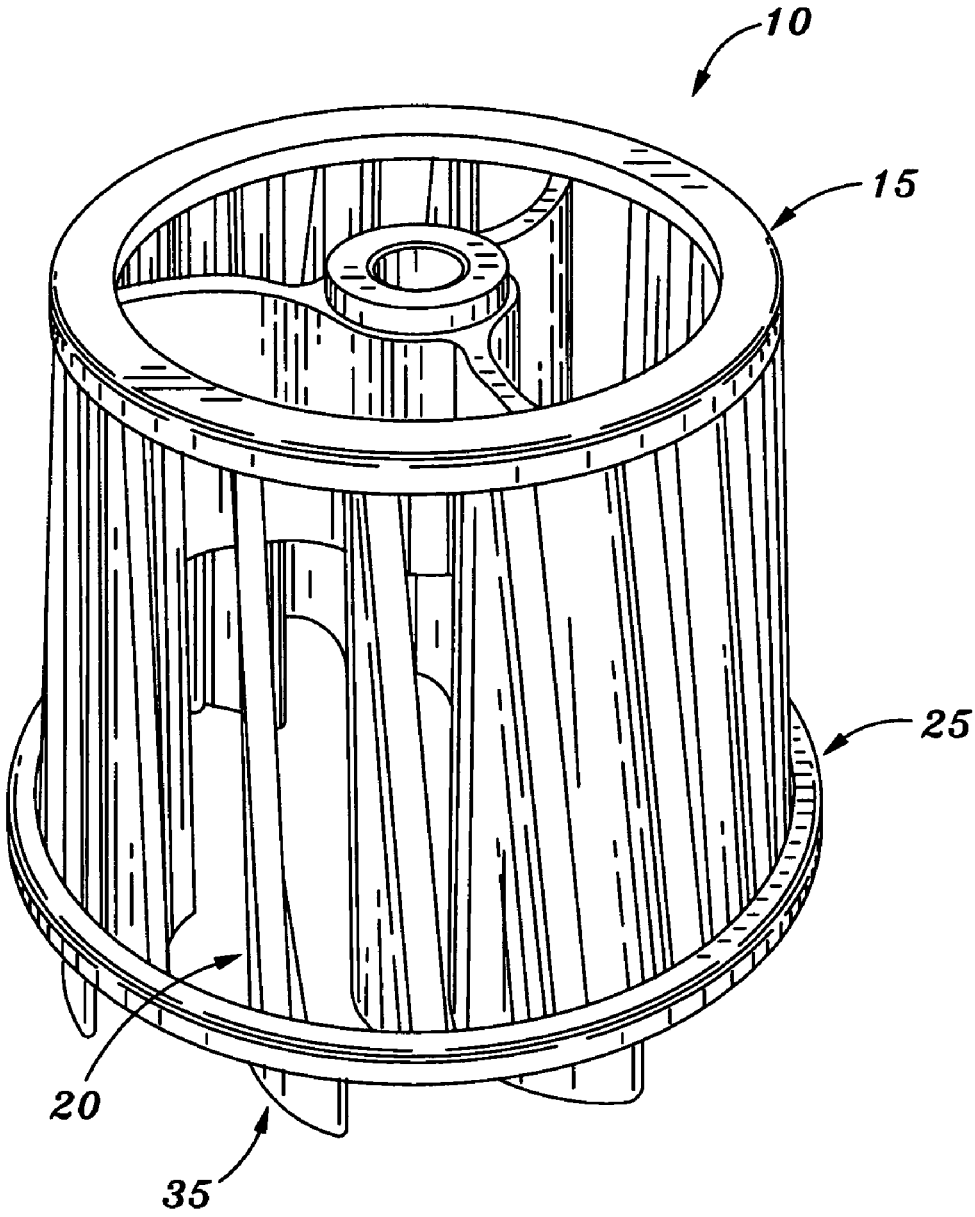
FIG. 1 is a perspective view of the mixing device of the present invention.
Figure 2:
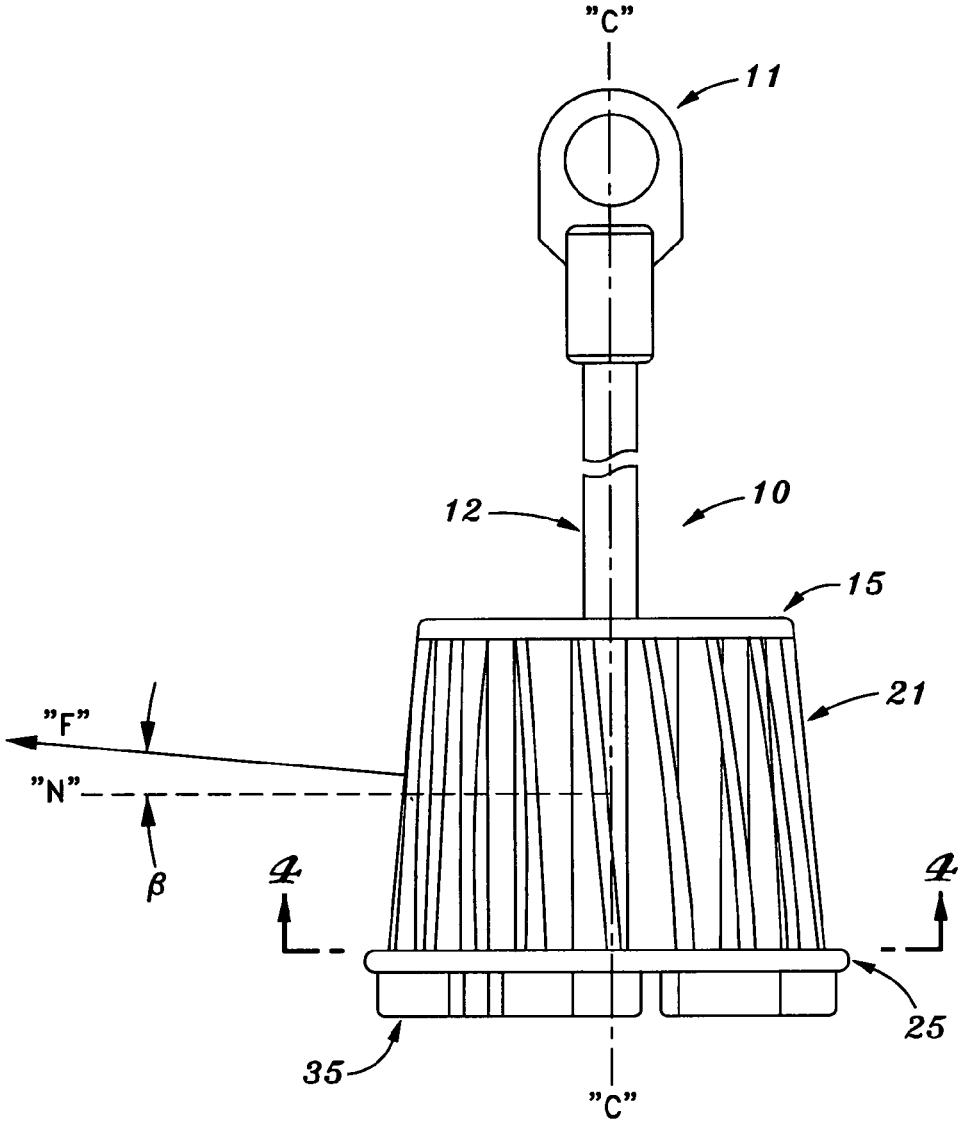
FIG. 2 is a side view of the mixing device of the present invention with the shaft truncated.
Figure 7:
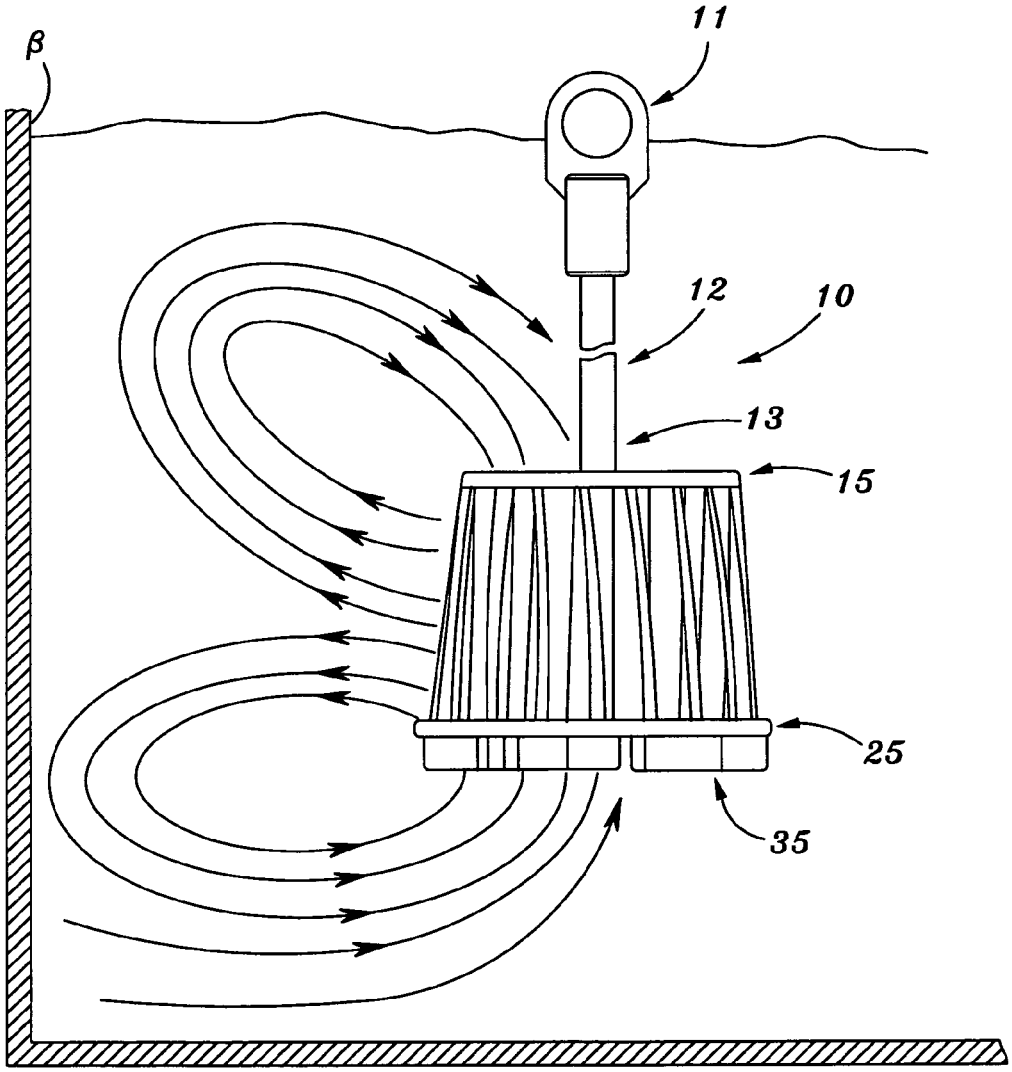
FIG. 7 is a side view of the mixer of the invention being used to mix a liquid such as paint.

Referring to FIGS. 2 and 7, as device 10 is rotated while in use, a low-pressure area is created in the interior of the device, which draws paint or other liquids into the mixer through the bottom and top openings thereof. The fluid is then accelerated over the curved surfaces of vanes 20 and is ejected radially outward past the outer edges 21 of vanes 20. The ejected fluid follows flow path F radially outward in a direction generally normal to the outer edge 21 of vanes 20, which as a result of the taper of vanes 20, is at an angle $\beta$ above the normal N perpendicular to shaft 12. FIG. 7 shows a typical flow path created inside a fluid container using mixing device 10. In an embodiment of the invention in which the outer surface of vanes 20 are tapered, e.g., because lower rim 25 is larger than upper rim 15, mixing is further improved because the greater angular velocity of lower rim 25 due to its larger radius will facilitate paint being ejected from the mixer at higher speed, thereby increasing the quality of mixing.

Mixing device 10 includes several features adapted to prevent the device from being clogged by paint globules or foreign matter. Vanes 20 are spaced so that most particulate matter or globules suspended in the paint will be ejected through vanes 20. As shown in FIGS. 2 and 7, because lower rim 25 is larger than upper rim 15, the spacing between the vanes increases from the top of the vanes toward the bottom of the vanes. The spacing between feet 35 is greater, generally corresponding to at least twice the spacing of the vanes at lower rim 25. It will be appreciated that the spacing of vanes 20 is typically dependent on the viscosity of the fluid being mixed and size of particulate matter suspended therein. As a result, the spacing of vanes 20 may vary, although it is preferable that the vanes are spaced at some point along their length to enable the most likely sizes of clogging particulates to pass through the vanes.

As discussed above, the interior cross-section of mixing device 10 is preferably frusto-conically shaped, with the lower portion of the vanes being tapered outward from the upper portion. In the event that a globule becomes lodged against the interior surface 22 of vanes 20, the outward force on the globule due to centrifugal force, together with the taper of the vanes will create a downward force on globule 43, pushing it toward the wider openings in the vanes at the lower portion thereof. In the event that the globule is large enough to avoid being ejected through the spacing in the vanes, it will eventually be ejected through feet 35 at the bottom of the mixing device.

Various alternative embodiments of the invention exist. For example, the device may include only a frusto-conical surface on the outer surface of the mixer, which would enable improved mixing, but without the globule ejection feature of the invention. In this embodiment, the inner edges of the vanes may be aligned generally parallel with or angled relative to the central axis, with only the outer edges of the vanes tapered outward to form the frusto-conical surface. Similarly, the device may include only a frusto-conical surface on the inner surface of the mixer, which would enable only the globule ejection feature of the invention. In this embodiment, the outer edges of the vanes may be aligned generally parallel with or angled relative to the central axis, with only the inner edges of the vanes tapered outward to form the frusto-conical surface. The device may also be constructed without the benefit of the upper and lower rims, provided that the vanes are attached to each other using other means sufficient to enable the device to operate as described.

More generally, although the invention has been described in detail for purposes of illustration, it is to be understood that such detail is solely for the purpose that of and that variations can be made therein by those skilled in the art without departing from the spirit and scope of the present invention.

What is claimed is as follows:

1. A device for mixing a liquid such as paint comprising:

a shaft for connection for to a rotary drive device; and a mixing device comprising a plurality of spaced vanes, each vane having an inner edge and an outer edge, said vanes arranged to extend in a substantially circular configuration and arranged such that said inner edges of said vanes define a frusto-conical boundary surface, said mixing device mounted for rotation by said shaft, said mixing device having a top and a bottom, said shaft extending outwardly beyond said top, and said mixing device including a lower rim at said bottom, a plurality of feet extending downward from said lower rim.

2. The device in accordance with claim 1 wherein said plurality of feet comprise portions of said plurality of vanes which extend beyond said lower rim.

3. The device in accordance with claim 2 wherein a first group of said plurality of vanes has a first length and a second group of the plurality of vanes has a second length longer than the first length, said vanes of said second group extending below said lower rim to define said feet, said vanes of said first group and said vanes of said second group arranged in an alternating pattern.

4. The device in accordance with claim 1 wherein said mixing device includes an upper rim spaced from said lower rim.

5. The device in accordance with claim 1 wherein said shaft is connected to said mixing device by at least one turbine.

6. The device in accordance with claim 5 wherein a plurality of turbines extend between the vanes and said shaft, each turbine having a first end attached to the shaft and a second end attached to one or more of said plurality of vanes.

7. The device in accordance with claim 6 wherein said turbines are aligned parallel with a central axis of said mixing device.

8. A device for mixing a liquid such as paint comprising:

a shaft having first end and a second end, said first end configured to be connected to a rotary drive device; and a mixing device mounted for rotation to said second end of said shaft, said mixing device comprising a plurality of spaced vanes, said vanes arranged in a substantially circular configuration about a central axis of said mixing device which is aligned with said shaft, said mixing device having a top and a bottom, said plurality of vanes positioned closer to said central axis at said top of said mixing device than at said bottom of said mixing device, whereby said mixing device has a generally frusto-conical shape, a hoop located at said bottom of said mixing device, and a plurality of feet extending from said hoop.

9. The device in accordance with claim 8 wherein said vanes have an inner edge and an outer edge, said inner edges of said vanes defining an frusto-conical interior boundary surface of said mixing device.

10. The device in accordance with claim 9 wherein said outer edges of said vanes define a frusto-conical outer surface of said mixing device.

11. The device in accordance with claim 8 wherein said mixing device includes a first hoop at said top of said mixing device and a second hoop at said bottom of said mixing device.

12. The device in accordance with claim 8 wherein said first hoop defines a top opening of a first size and said second hoop defines a bottom opening of a second size which is larger than said first size.

13. The device in accordance with claim 8 including at least one turbine connecting said shaft to said vanes.

14. The device in accordance with claim 13 wherein each turbine has a first end connected to said shaft and second end connected to at least one of said vanes and wherein each turbine is generally aligned in a direction parallel to said central axis.

15. The device in accordance with claim 13 wherein each of said feet are defined by portions of said plurality of vanes extending beyond said hoop.

16. The device in accordance with claim 8 wherein said feet extend from said hoop inwardly towards said center axis.

17. The device in accordance with claim 16 wherein said fee are curved.

18. The device in accordance with claim 8 wherein said vanes have an inner edge and an outer edge and are curved in a first direction between said inner and outer edges, and including a plurality of turbines connecting said shaft to one or more of said plurality of vanes, each of said turbines having a first end and a second end, said turbines curved between said first and second ends in said first direction.

19. The device in accordance with claim 18 wherein three turbines are spaced apart at said top of said mixing device.

* * * * *